US007802509B2

(12) United States Patent
Wall

(10) Patent No.: US 7,802,509 B2
(45) Date of Patent: Sep. 28, 2010

(54) TACTICAL UTILITY POLE SYSTEM AND METHOD OF USE THEREOF

(76) Inventor: Marcus L Wall, 20502 Oak Forest, Damon, TX (US) 77430

( * ) Notice: Subject to any disclaimer, the term of this patent is extended or adjusted under 35 U.S.C. 154(b) by 852 days.

(21) Appl. No.: 11/693,287

(22) Filed: Mar. 29, 2007

(65) Prior Publication Data

US 2008/0236377 A1 Oct. 2, 2008

(51) Int. Cl.
*F41F 7/00* (2006.01)

(52) U.S. Cl. ..... 89/1.14

(58) Field of Classification Search ..... 42/1.08; 89/1.11, 1.14; 173/90
See application file for complete search history.

(56) References Cited

U.S. PATENT DOCUMENTS 1,506,068 A * 8/1924 Lange ..... 43/6
2,719,716 A * 10/1955 Sawtelle ..... 273/129 R
2,783,581 A * 3/1957 Lee ..... 43/124
3,365,828 A 1/1968 Badali
3,538,635 A 11/1970 Friend
3,733,727 A 5/1973 Jones
3,782,021 A 1/1974 Atchisson
3,791,303 A 2/1974 Sweeney
4,282,714 A 8/1981 Fiocchi
4,336,743 A 6/1982 Horn
4,644,845 A 2/1987 Garehime
4,848,209 A 7/1989 Almeras
4,856,430 A 8/1989 Gibb
5,088,174 A 2/1992 Hull
5,167,043 A 12/1992 Lopez
5,177,850 A 1/1993 Hull
5,196,647 A 3/1993 Majors
5,237,613 A 8/1993 Berry
5,261,162 A * 11/1993 Siegler ..... 30/216
5,329,685 A 7/1994 Gilliespie
5,415,241 A 5/1995 Ruffu
5,690,089 A 11/1997 Ward
5,747,719 A 5/1998 Bottesch
5,883,328 A 3/1999 A'Costa
5,987,723 A * 11/1999 McNally et al. ..... 29/254
6,032,846 A 3/2000 Clark
6,272,781 B1 8/2001 Resnick
6,276,085 B1 8/2001 Wooten
6,318,228 B1 11/2001 Thompson
6,408,763 B1 6/2002 Hurtta
6,449,419 B1 9/2002 Brough (Continued)

OTHER PUBLICATIONS http://www.lpstactical.com/bangpole.htm. Printout of web page advertising prior art tactical utility pole.

(Continued)

*Primary Examiner*—Troy Chambers
(74) *Attorney, Agent, or Firm*—Leyendecker & Lemire LLC; Kurt Leyendecker

(57) ABSTRACT

A tactical utility pole system for use by law enforcement is described. Embodiments of the system are user configurable depending on a particular tactical need. Variations are described for breaching a locked door, breaching a closed window and delivering and nearly instantaneously detonating a distraction within the associated structure, breaching a closed window and delivering a stream of OC or other chemical spray within the associated structure, and breaching a closed window and delivering a chemical grenade within the structure. Other variations are also contemplated.

16 Claims, 13 Drawing Sheets

U.S. PATENT DOCUMENTS

| | | | | |
|---|---|---|---|---|
| 6,490,957 | B1 | 12/2002 | Alexander | |
| 6,543,173 | B1 | 4/2003 | Golan | |
| 6,564,687 | B2 | 5/2003 | Poole | |
| 6,608,677 | B1 | 8/2003 | Ray | |
| 6,631,668 | B1 | 10/2003 | Wilson | |
| 6,655,143 | B2 | 12/2003 | Daunas | |
| 6,688,032 | B1 | 2/2004 | Gonzalez | |
| 7,047,863 | B2 | 5/2006 | Hawkes | |
| 7,051,528 | B2 | 5/2006 | Daunas | |
| 7,305,788 | B1 * | 12/2007 | McLain | 42/1.08 |
| 7,437,847 | B1 * | 10/2008 | Mabry | 42/71.02 |
| 2003/0047105 | A1 | 3/2003 | Vasel | |
| 2003/0145719 | A1 | 8/2003 | Friedli | |
| 2004/0031184 | A1 | 2/2004 | Hope | |
| 2004/0075585 | A1 | 4/2004 | Kaiser | |
| 2004/0200342 | A1 | 10/2004 | Sansolo | |
| 2005/0188886 | A1 | 9/2005 | Vasel | |
| 2005/0211084 | A1 | 9/2005 | Trela | |
| 2005/0225448 | A1 | 10/2005 | Schenker | |

OTHER PUBLICATIONS http://www.defense-technology.com/products.aspx?pid=7001CI. Printout of website pages concerning the distraction round utilized in various embodiments.

* cited by examiner

TACTICAL UTILITY POLE SYSTEM AND METHOD OF USE THEREOF

FIELD OF THE INVENTION

The invention pertains to tactical devices used by police, paramilitary personnel, penal institutions, emergency rescue personnel and/or military personnel.

BACKGROUND

In hostage situations and in pursuit of suspects, the suspects will often hide or take refuge in a building or other structure as protection from their pursuers. While specialized negotiators will often be called in to communicate with the suspects and get them to peaceably surrender, often law enforcement, typically a SWAT team will have to storm the building to apprehend the suspect(s) and, as applicable, free any hostages.

Obviously, law enforcement personnel making an entrance into a building that is occupied by an armed suspect wants to do so as quickly and efficiently as possible, hopefully when the suspects are distracted or otherwise occupied. Accordingly, it behooves law enforcement to make as quick an entrance as is reasonably possible without needlessly endangering the lives of any hostages and the suspect(s).

Explosive distraction rounds are known as devices that are thrown into a building typically through a window that explode with a load ear-piercing bang and a bright flash of light. As the name implies, the purpose of these rounds is to momentarily distract the suspect(s) and other persons in a building so that nearly simultaneously law enforcement personnel can enter the building and hopefully, incapacitate the suspect(s). Using the practice that is current in the art, the distraction round is thrown into a room where the suspects are believed to be located after an entrance means is identified or secured. For instance, a distraction round grenade may be launched through a window and timed via its fuse to detonate a short period of time thereafter.

Alternatively, it is known to deliver distraction rounds grenades or chemical agent grenades into buildings using extension poles. Typically, such poles are usually handmade and often improvised for a particular need and situation. The grenade may be taped or otherwise secured to the pole's end and is detonated by the pulling the release pin on the grenade using a string or cable and waiting the typical three second delay. Needless to say, improvised hand-made pole delivery devices are not very reliable and often don't provide the precision timing that could be critical in defusing a hostage situation. In all of these scenarios, there is a time delay from the moment that the device is activated or triggered then thrown by the operator or activated to explode by the operator who has attached it to a pole and the time the device actually explodes (usually, but not necessarily 3 seconds.) Not only does this delay cause a delay in the explosion and subsequent rescue, it is also a time when the device cannot be turned "off" or de-activated. The delay caused by the activation of the fuse prevents the operator's ability to change his mind, thus resulting in a possibly needless injury to people who may wander into close proximity of the device during the 3 second delay when the explosion, at this point, cannot be aborted.

At least one extension pole system, referred to as the BangPole, is available through LPS Tactical & Personal Security Supply of Newark, Calif. as described at www.lpstactical-.com/bangpole.htm. The pole device comprises a telescoping locking pole, a clamp for accepting a diversionary device from one of a list of suppliers, an internal lanyard, a window rake, a screw in extension piece, handgrips and a belt mounted support unit. Mirror and camera mounts are also available for use with the BangPole. The BangPole, however, offers only minor advantages over the make-shift improvised pole described above and suffers from many of the same deficiencies as an improvised pole. For instance, the BangPole is substantially constructed of relatively light gauge materials and does not provide any means for angling the pole at a location along its length to provide greater leverage when using the window rake function as well as causing a more visible exposure of the user to an armed suspect located on the other side of the window. The BangPole is also a light duty device that is not constructed in a manner that would permit it to be used to impart a significant impact force on a window, such as to easily break through the window's glass although the website literature indicates a steel mini-ram is available to "port and rake barred windows". Its primary functions are limited to surveillance such as when a camera or mirror is attached thereto, and delivering distraction grenades into a building by way of an open window or perhaps a thinly paned window. The device fails to offer the ability to simultaneously carry out surveillance and deliver a distraction round, let alone break and rake a window and then deliver a distraction round immediately thereafter without changing pole heads.

One other major deficiency of the bang pole is that, like improvised poles, it relies on a cable or lanyard system for the detonation of a flash or chemical grenade subjecting it to the same timing delays and inefficiencies as the homemade poles. It is further appreciated that the lanyard system of detonating a grenade is subject to malfunction and does on occasion fail to work. For instance, if the grenade canister becomes canted in its holder relative to the lanyard and cable, the user may not be able to pull the pin from the grenade. In critical hostage situations, a miscue as a result of a failed flash or chemical grenade detonation can have deadly consequences for hostages and law enforcement personnel.

When storming a building, such as in a hostage situation, the police and/or SWAT personnel must often gain entrance through a locked door. Traditionally, one of several methods is used. An officer may slam his shoulder against the door hoping to break it open. This is often not effective, especially in the case of reinforced and/or solid wood doors, and may cause injury to the officer. Alternatively, a battering ram may be utilized. However, this requires the officer(s) operating the ram to stand substantially in front of the door wherein they might be vulnerable to an armed suspect either shooting through the door or shooting the officers once the door is breached and they are revealed to the suspect. It is not uncommon for the ram to be slammed against the door multiple times during the attempt to force open the door. Very often, the door does not open on the first strike of the ram. During this time of multiple strikes, the suspects inside the objective are being alerted every time the ram hits the door while the officer that is striking the door with the ram is standing substantially in front of the door. Even when an officer goes to simply "knock" on the front door of a residence during a minor investigation, he or she is thought to never stand in front of the door. It is through the door that the suspect usually discharges his weapon if attempting to shoot the officer in this scenario. With the currently used ramming techniques (using a hard, heavy metal ram to strike the front door in a nearly linear motion), the officer must stand in from of the door in order to hold, guide and propel the ram effectively in high risk entries. If the door does not open with the first attempt, the suspects have been alerted, the hostages are at risk, and the officers assigned to enter the location are at risk.

Explosive devices are known that fire shot or other particulate through the door to disable the locking mechanism and allow entrance. They also generally require a user to stand in front of the door, but perhaps more significantly, the risk that particulate will penetrate through the door or ricochet back at an officer and injure a hostage or the officer is often too high to justify their use.

Given the current state of technology concerning breaching and securing a building occupied by one or more suspects potentially in a hostage situation is extremely risky for police and Swat teams. Furthermore, the timing in such an operation is critical. The failure to adequately coordinate the detonation of a distraction round with the forced breach of a door can have disastrous consequences including the loss of police and civilian lives.

DETAILED DESCRIPTION

Figure 1:
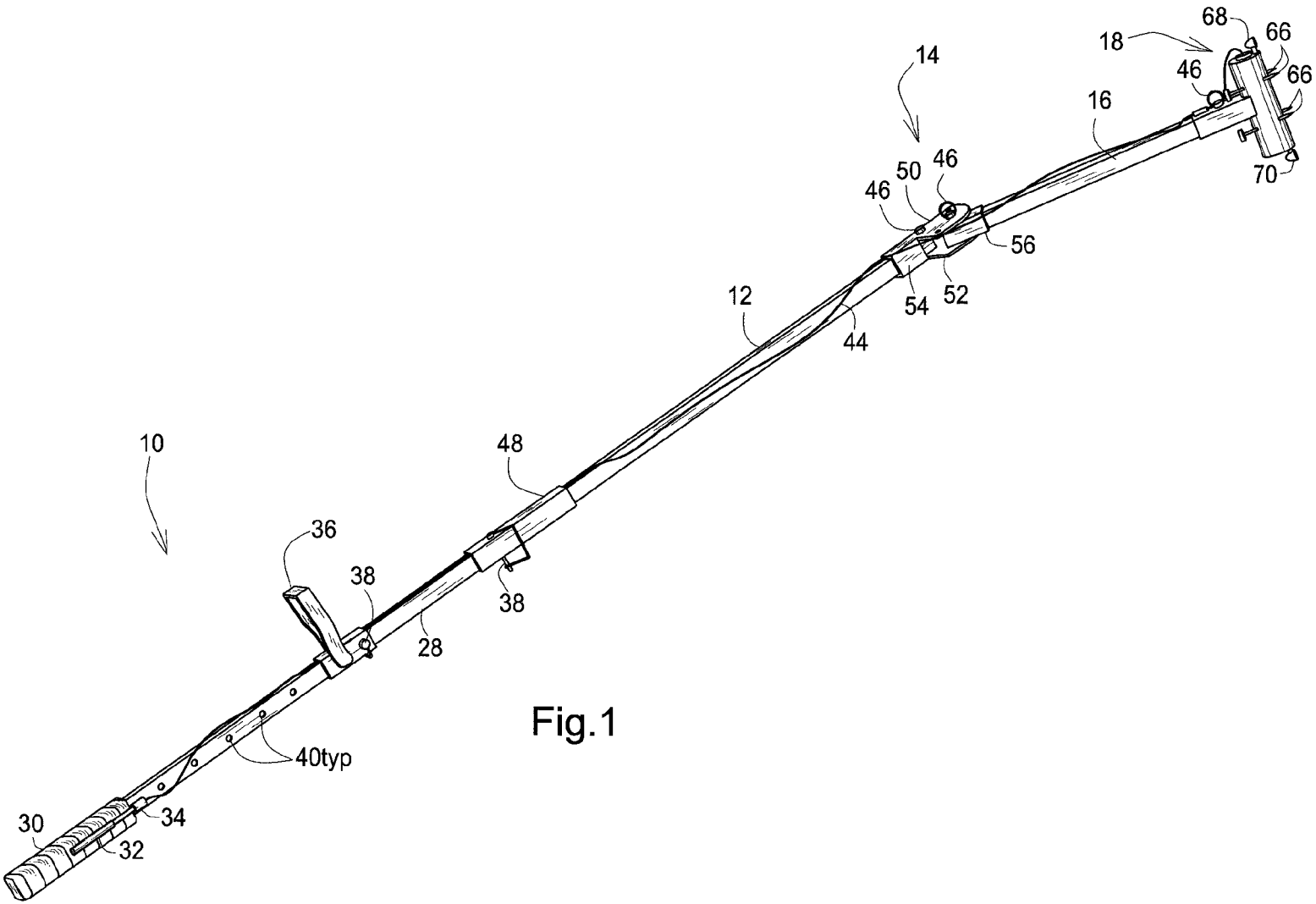
FIG. 1 is an isometric view of a configuration of the tactical utility pole system including an attachment for breaching a window and delivering a chemical or flash grenade into a structure according to an embodiment of the present invention.

Embodiments of the present invention ameliorate many of the issues and problems with ad hoc and commercial prior art utility pole systems. For instance, embodiments of the utility pole system are fully customizable for most situations that would require their use. The pole can be extended a substantial distance to the use of extension tubes allowing its use to breach the second floor of an intended structure. An elbow assembly/section is also provided that permits a user to angle the head of the utility pole relative to its handle. This permits a user to obtain a greater degree of leverage such as might be necessary when braking through window. The ability to angle a particular configuration of the utility pole also permits the user to stand clear of a door or window, and along side the structure to reduce the exposure of the officer, thereby lessening the risk that he or she will be hit by any projectiles fired from within the structure at the window or door.

The construction of embodiments of the utility pole system facilitates its quick or rapid configuration (usually under 3-5 minutes) for a particular purpose. Typically, the handle tubes, the handle assemblies, the extension tubes, the elbow assembly, and the end attachments can all be secured by way of quick release pins. Accordingly, a user can assemble a particular configuration to serve the particular needs of particular situation quickly, to take advantage of any tactical situation that might first present itself. In certain embodiments, assembly and disassembly can be accomplished without the use of extraneous tools, such as screwdrivers or wrenches. Effectively, the connections between the various sections comprise quick release couplings/fittings, which in several embodiments are essentially integral with the various sections and attachments.

The tactical utility pole system includes a plurality of pole end attachments depending on the particular use of any particular configuration. One distraction device (round) delivery attachment comprises a cylindrical housing adapted to contain a distraction round, such as a flash bang grenade. This attachment is typically comprised of steel or heavy gauge aluminum and includes several breaching points/spikes extending out of a front end thereof for breaking glass. Operationally, a user breaks the glass and clears the window into the room in which he desires to detonate the distraction device. Once the attachment head is in the room he can immediately detonate distraction device without appreciable detonation delay by way of a pin gun located on the handle tube.

There are several advantages of an embodiment configured for distraction device delivery over the prior art. First, the construction of the tactical utility pole system facilitates its use as a battering device, such as to break windows and/or clear window openings of blinds, curtains, shutters and other obstructions. The hardened breaching points/spikes located on the front of the distraction device delivery attachment facilitate the braking or shattering of window glass. The pin gun, which is operatively coupled to distraction device by way of a shock tube, permits practically instantaneous detonation of the distraction device eliminating the timing uncertainty when grenade type devices are utilized.

Variations of the distraction device delivery attachment can include lights, typically LEDs, possibly of differing colors and/or a video camera. Bright White LEDs in combination with a video camera and a small monitor typically located proximate to handle assembly permit a user to assess the situation within a room prior to detonating a distraction device. For example, a user might realize that hostages are located in close proximity to the window that is just been breached and accordingly it would be unsafe to detonate distraction device. Alternatively, the camera might indicate that there is no one in of interest in the room and as such igniting a distraction device and sending personnel into the building coinciding with the distraction device's detonation would be both fruitless and dangerous.

In other variations, colored LEDs, such as red and blue LEDs, can be provided. Further, they may be attached to strobe circuitry such that they flash to indicate the presence of the device within the room and to identify the operators as Police Officers. Any one of these variations may also include speakers and/or microphones that permit communication between a person of interest in the room and the law enforcement officials outside of the structure.

Embodiments of the invention include a second type of distraction device delivery attachment, which is adapted to receive two distraction devices that can be independently detonated. Like the first type of distraction device delivery attachment mentioned above, the second type includes a plurality of breaching points to facilitate the breaking of glass with relative ease. Typically, this attachment is utilized in combination with a handle tube having to pin guns attached thereto with a shock tube running from each gun to one of the distraction devices. Variations of the second type distraction device delivery attachment may also include various lights, a video camera, a speaker and/or microphone. Operationally, the second type attachment is used in substantially the same manner as the first type of distraction deliver device attachment.

A chemical spray delivery attachment is utilized in certain embodiments for breaking a window, raking any obstructions from around the window and delivering OC or CS spray from an OC or CS canister into an associated room. Like the attachments described above, variations of this attachment can include lights, a camera, a microphone and/or a speaker.

Door breaching attachments are utilized in certain embodiments to breach a locked door. Typically, each of these attachments comprise a boxlike structure having an open front face with substantially planar edges, which is placed against the door, typically around the door hardware. The distraction device, typically a flash bang round, is secured within the boxlike structure. A shock tube extends from the distraction device to a pin gun located on the handle tube. After placing the boxlike structure against the door the user detonates the distraction device via the pin gun. The boxlike structure directs the shockwave from the explosion towards the door causing damage to the door, the door jamb and/or the door hardware thereby blasting the door open.

The door breaching attachment differs from prior art devices in several significant ways. For one, no appreciable explosive particulate is utilized. Rather, the destructive force used to damage the door is primarily a shockwave. Because of this, the risk of injury to hostages and suspects within the structure by projectiles is reduced. Furthermore, with the use of a 90° or multi-angled elbow, the user is able to stand clear of the door reducing the risk that a suspect on the other side of the door will be able to shoot and injure the user. Two variations of the door breaching attachment are described; one using a single distraction device and another that utilizes two distraction devices that are detonated simultaneously.

A chemical grenade delivery attachment is designed to deliver a chemical grenade, such as a teargas grenade, into a structure. The grenade delivery system comprises an enclosure which holds the spoon of the grenade tightly against the side of the grenade. The bottom of the enclosure is generally open safe or catch. This catch normally holds the grenade in place. When the catch is remotely retracted, the grenade is ejected from the housing by way of a spring thereby causing the spoon to release and activate the grenade's fuze. The front of the housing is typically pointed and comprises a breaching edge that can be utilized to break glass. Alternatively, several breaching points/spikes may be provided on the front of the housing. The catch can be remotely released to any suitable means including a cable that extends from the catch to a mechanical trigger/actuator located on one of the handle tube and the handle assembly. In other variations, the catch can be operated by a solenoid that is electronically triggered. As with several of the previous attachments, the grenade delivery attachment can include lights, camera, a microphone and/or speaker.

Numerous other attachment devices are contemplated, such as those that can deliver items to a person or people within a structure. For instance, law enforcement may want to deliver a walkie-talkie to suspect to facilitate surrender negotiations. Or someone within the structure may require medicine that can be delivered using an appropriate device. Attachment devices are contemplated comprised primarily of a camera and associated lights with or without speakers and microphone. As with all the other attachment devices described herein, they are typically constructed to be quickly and efficiently configured in an embodiment of the tactical utility pole system.

Terminology

The term "or" as used in this specification and the appended claims is not meant to be exclusive rather the term is inclusive meaning "either or both".

References in the specification to "one embodiment", "an embodiment", "a preferred embodiment", "an alternative embodiment", "one variation", "a variations" and similar phrases mean that a particular feature, structure, or characteristic described in connection with the embodiment is included in at least an embodiment of the invention. The appearance of the phrase "in one embodiment" in various places in the specification are all not necessarily meant to refer to the same embodiment.

The term "couple" or "coupled" as used in this specification and the appended claims refers to either an indirect or direct connection between the identified elements, components or objects. Often the manner of the coupling will be related specifically to the manner in which the two coupled elements interact.

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiments and are not necessarily intended to be construed as limiting.

As applicable, the terms "about" or "generally" as used herein unless otherwise indicated means a margin of +−20%. Also, as applicable, the term "substantially" as used herein unless otherwise indicated means a margin of +−10%. It is to be appreciated that not all uses of the above terms are quantifiable such that the referenced ranges can be applied.

The terms "switch" or "switches" as used herein to refer to any device for controlling the flow of current through an electrical trace and is not limited to any particular type of configuration of a switch including but not limited to toggle switches, buttons, rocker switches and touch sensitive switches. The phrase "trigger mechanism" as used herein refers to any device or assembly designed to actuate, detonate, and/or facilitate operation of a feature typically on an attachment device. A trigger mechanism can be primarily mechanical such as a cable and a lever, it can utilize explosives such as the pin gun and shock tube combination or it can be partially or wholly electronic in nature such as a switch, electrical wiring and an electronic detonator. "Actuator" as used herein can be either a mechanical or electrical actuator.

As described herein the tactical utility pole is typically comprised of a plurality of poles most often in the form of a tube that are joined/coupled to form an assembly. As used herein the terms "pole" and "boom" are used generally interchangeably to describe an elongated structure that is not necessarily a "tube."

An Embodiment of a Typical Tactical Utility Pole System

Referring to FIG. 1, an embodiment of a tactical utility pole system in a configuration designed to deliver distraction device through a window into a structure is illustrated. Most basically, the illustrated assembly comprises: (i) a handle tube assembly 10 including a handle tube section 28, a handle assembly 36 and a pin gun mount 32; (ii) an extension tube section 12 coupled with the handle tube; (iii) an elbow assembly 14 coupled with the distal end of the extension tube; (iv) an elbow extension tube 16 extending hourly from the elbow assembly; and (v) a distraction device delivery attachment 18 coupled to the distal end of the elbow extension tube. These various components are coupled together by way of one or more quick release pins 38 & 46 thereby forming a quick release coupling. A first type quick release pin 38 comprises a solid pin and a resilient wire form that is hooked over the end of the pin to secure it in place. A second type quick release pin 46 comprises any of the least partially hollow shaft having an hourly biased ball contained therein and extending partially outwardly from a hole located along the side of the shaft proximate its distal end. Typically, either type of pin may be used interchangeably with the other type of pin to quickly assemble and disassemble various configurations of the tactical utility pole system.

The various tubes utilized in the tactical utility pole system are typically comprised of aluminum so that the resulting assembly can be both strong and relatively light. It is appreciated, however, that the tubes may be comprised of any suitable material including, but not limited to a steel alloy or a composite material. As illustrated, the tubes are of a generally square cross-section that facilitates quick assembly in a proper and correct orientation. Again, however, other tubes of other non-circular cross-sectional shapes can be used in other variations. Further, a tactical utility pole system is contemplated that utilizes cylindrical tubing.

In at least one embodiment, the tubes have a square cross section either 1.50" or 1.25" in outside width and are comprised of 14 gauge aluminum (0.065" thick). Accordingly, the smaller tubes can easily be slid into the larger tubes as necessary to couple the various sections of an assembly together. Any suitable aluminum alloy can be utilized including, but not limited to, 6061 and 6063 alloys in any suitable temper.

Figure 4:
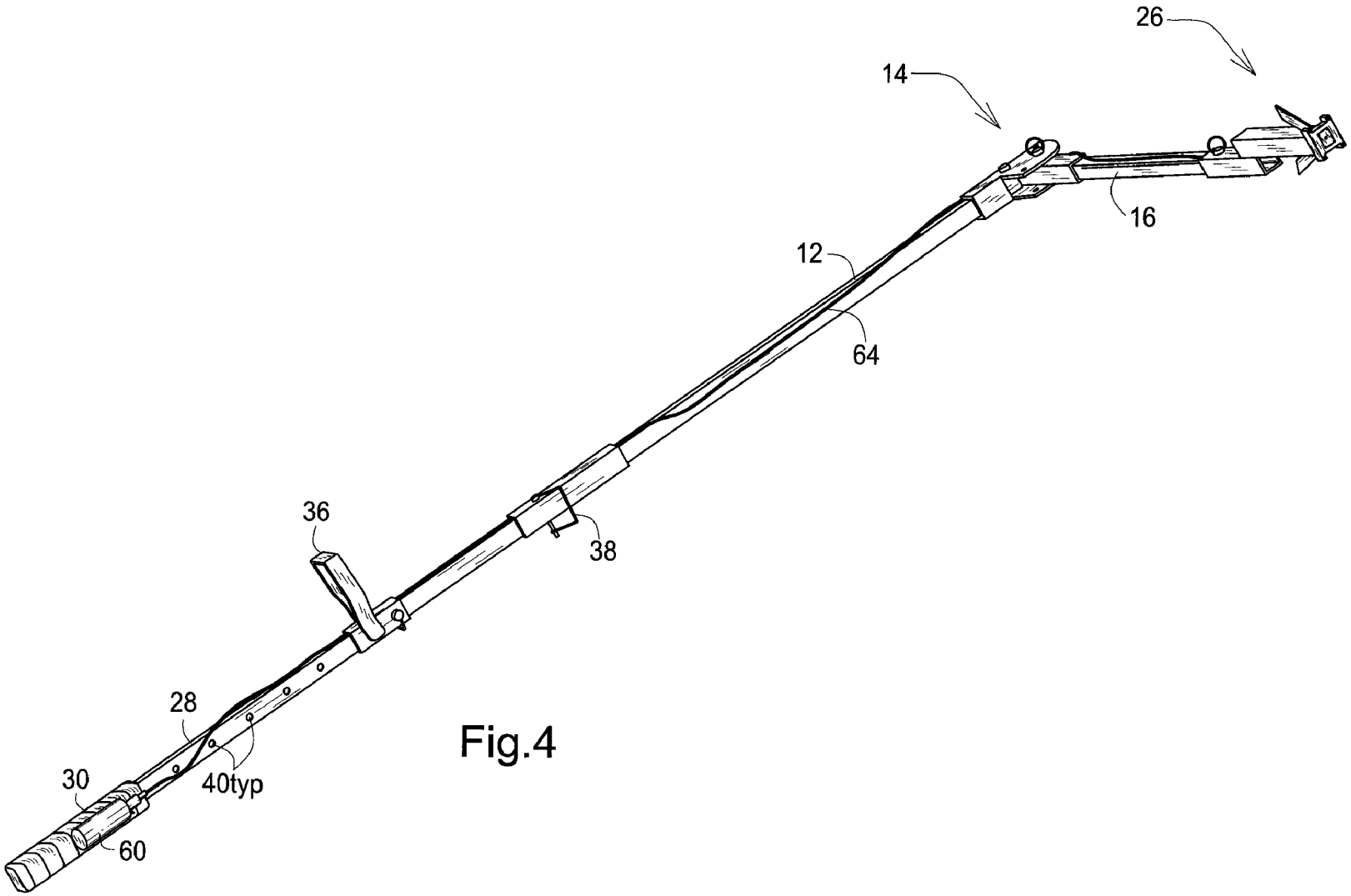
FIG. 4 is an isometric view of another configuration of the tactical utility pole system including an attachment for breaking a window and raking any obstructions there from according to an embodiment of the present invention.

The handle tube 28 is generally widest at its proximal end where it may be wrapped with a cushioned tape 30 to serve as a handhold. Different variations of a handle tube are contemplated depending on the particular use of an assembly. For instance, a single pin gun mount 32 to which a pin gun 34 can be attached is provided in the handle tube of the tactical utility Pole configuration illustrated in FIG. 1; whereas, a handle tube illustrated in FIG. 2 includes dual opposing pin gun mounts as are necessary to allow two pin guns to be mounted to a particular configuration utilizing the dual distraction device delivery attachment 20. Yet another handle assembly variation is illustrated in FIG. 4 wherein a mount (not specifically illustrated) is provided for securing and an OC canister 60 to the handle tube, although it can be appreciated that in some variations the OC canister may be secured to the handle tube by way of the pin gun mount or separately using a strap, such as a continuous band clamp.

The handle tube also includes a plurality of spaced sets of holes 40 extending through it perpendicularly to its longitudinal axis. These holes are adapted to receive quick release pins 38&46 therethrough and to secure a handle assembly 36 to the tube. The first type of handle assembly is illustrated in FIG. 1. It comprises a receiver tube that is received over the handle tube 28 and slid to a location wherein a set of pin holes in handle assembly a line with a desired set of pin holes in handle tube. A quick release pin is then slid through the aligned sets of holes to secure the handle assembly in a desired location along the handle tube. The plurality of spaced holes permit a particular user to adjust the location of the handle assembly based on his/her arm length and reach. Extending upwardly from the receiver tube are a pair of arms that diverge outwardly from the receiver tube. At their distal ends, a handle portion spans the gap between the arms and provides a handhold location for a user to grab the handle assembly. Various buttons and/or switches or activating devices (not specifically illustrated), such as a cable pull lever, maybe attached to the handle assembly for selective operation and engagement by a user.

Figure 2:
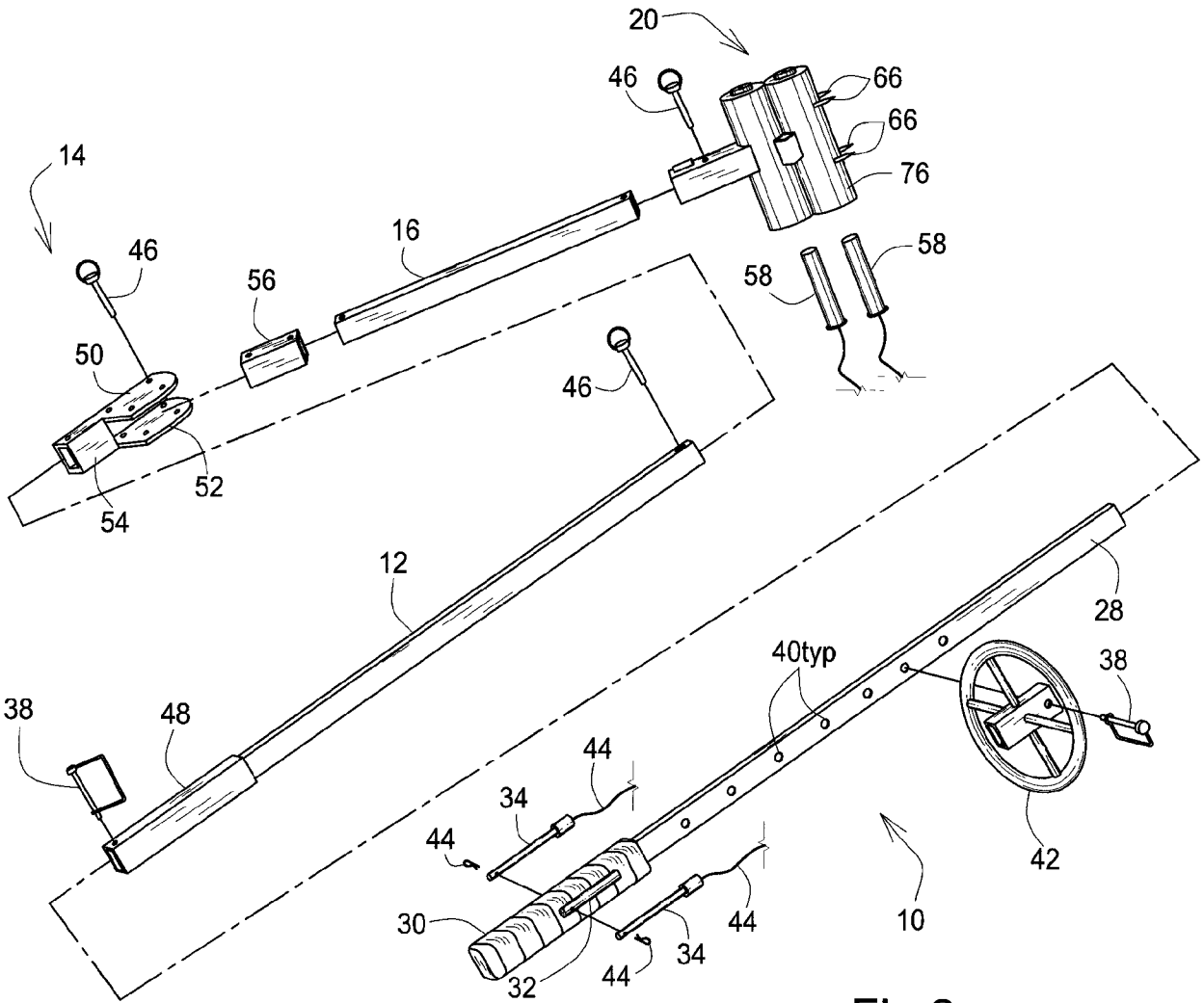
FIG. 2 is an unexploded isometric view of another configuration of the tactical utility pole system including an attachment for breaching the window and delivering up to two chemical or flash grenades into a structure according to an embodiment of the present invention.

A second type of handle assembly 42 is illustrated in FIG. 2. This handle assembly includes a receiver tube similar to the receiver tube of the first type handle assembly. The handle portion of the second type handle assembly comprises an arcuate cylindrical ring that extends around the receiver tube. The cylindrical ring is secured to the receiver tube by way of the plurality of spokes extending between the cylindrical ring and the receiver tube. Like with the first type handle assembly various switches and actuators maybe attached thereto.

As mentioned above, one or two pin gun mounts 32 are provided on a handle tube permitting one or two pin guns 34 to be attached to the handle tube. Typically, a pin gun is slid into the cylindrical pin gun mount and secured therein with a cotter pin 44. The pin gun is a user activated device for firing a shotgun shell primer or other type of explosive cap. A trigger is provided to release and send a spring-loaded hammer against the primer causing the explosive charge contained within the primer to ignite. In variations of the pin guns used with a tactical utility pole assembly, a cotter pin trigger guard mechanism may be provided wherein a user is unable to release the trigger unless the cotter pin safety is removed. The distal end of the pin gun is adapted to couple with a flexible shock tube 44. Upon firing, a shockwave generated by the explosion of the primer charge is directed through the shock tube to a distraction device 58 located in the desired attachment at the end of a configured tactical utility pole assembly.

In several embodiments and configurations of the tactical utility pole system, the shock tube 44 is connected at a distal end to a distraction device 58. Operationally, the distraction device is initiated by the shockwave generated by the pin gun. The type of distraction device/round used most commonly with certain configurations of the system is a flash and bang charge. This distraction device is an explosive designed primarily to create an ear piercing noise and a bright visual flash. The intent of the device is to momentarily cause anyone within its relative proximity to divert their attention to the flash and the bang, thereby distracting them long enough to permit a forced entry into a structure at a location different from the location at which the distraction device was detonated. One type of distraction round suited for use with embodiments of the tactical utility pole system is the #25CI made by Defense Technology of Casper, Wyoming or similarly configured rounds. This particular round is also referred to as a command initiated reload. It is designed to be detonated via a shock wave from a shock tube and includes a coupling to attach it to a shock tube. This round also has a threaded male portion at one end to secure it in place. It is appreciated that the primary purpose of this type of explosive device is not to cause damage or inflict injury as a result of the associated explosion. Rather, it is intended to be relatively safe, such that it can be used in a room containing both suspects and hostages.

Depending on the particular configuration of the tactical utility pole assembly, an extension pole 12 may be coupled to the distal end of the handle tube 28 using any suitable quick release pin 38&46. The extension tube can be of any desired length and multiple extension tubes can be coupled together to provide an even greater reach for the device. For example, two or three yard long tubes might be utilized in a configuration intended to reach a window on a second story. As illustrated best in FIG. 2, the extension tube is typically comprised of two tubular pieces that are typically welded together. A short receiver tube section 48 has an inside dimension similar to the outside of dimension of the distal end of the handle assembly such that the distal end of the handle assembly can be slid therein in secured with the quick release pin. The primary section of the extension tube as exterior dimensions generally similar to those of the handle tube, and as shown, in manufacture, the end of the primary section is slid partially into the receiver section and welded in place.

Is appreciated that in variations and other embodiments that the extension tube could be replaced by a two-piece assembly comprising a separate primary section and a separate receiver tube section. In the assembly of this variation, a user would place the receiver tube over one end of the extension tube primary section or the end of the handle tube and pin that combination in place. Secondly, the user would slide the other of the extension tube primary section and the handle tube into the other end of the receiver section and pin it in place as well.

Figure 3:
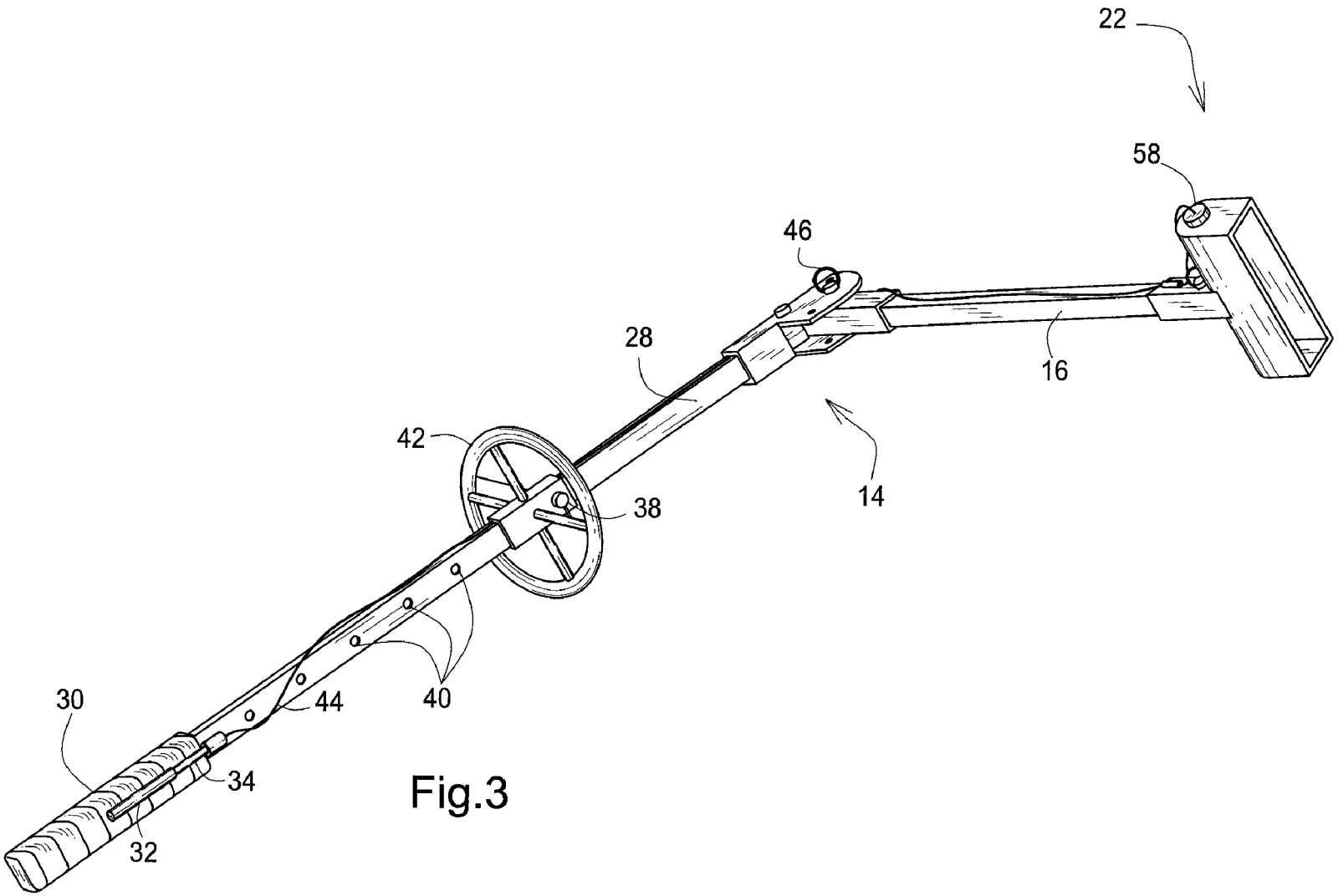
FIG. 3 is an isometric view of a yet another configuration of the tactical utility pole system including an attachment for obtaining forcible entry through a locked door according to an embodiment of the present invention.

Next, as illustrated in the configurations of FIGS. 1-3, the distal end of the extension tube is coupled with an elbow assembly 14. However, as mentioned above, any number of extension tubes 12 may be daisy chained together. Further, an end attachment can be coupled directly to the end of the extension tube as might be suitable for certain uses of the tactical utility pole system. In short, it is to be understood that the tactical utility pole system of embodiments described herein is capable of being configured in a myriad of combinations and is not limited particularly to the combinations described or illustrated in this disclosure.

The elbow assembly is best described with reference to FIG. 2. It comprises a fixed elbow receiver tube portion 54 welded to or otherwise attached to upper and lower plates 50&52. The distance between the upper and lower plates is sufficient to receive a pivotal elbow receiver tube 56 that can have its angle adjusted relative to the fixed elbow receiver tube. As suitable, both receiver tubes include one or more sets of holes for receiving quick release pins and coupling the elbow assembly to extension tubes.

Referring specifically to FIG. 2, the pivotal elbow receiver tube 56 includes two sets of holes. The first set located at a proximal end thereof corresponds with a set of holes in the upper and lower plates. When the sets of holes are lined and a pin or bolt is placed through the aligned holes, the pivotal elbow receiver tube is free to pivot about an axis of the pin or bolt causing the second set of holes located at distal end of the pivotal elbow receiver tube to travel in an arc. The second set of holes can be moved into several positions that align with sets of holes in the upper and lower plates. When a quick release pin is placed through the aligned sets of holes, the pivotal elbow receiver tube is locked into position wherein the axis of the pivotal elbow receiver tube forms an angle relative to the axis of the fixed elbow receiver tube 54. In the illustrated embodiment, the pivotal elbow receiver tube can be locked at angular locations of 0°, 45° and 90° relative to the fixed receiver tube. Other variations are contemplated wherein the angle of the various locking positions differs from those listed above. It is also appreciated that other locking mechanisms may be utilized in place of the combination of sets of holes and quick release pins to secure a pivotal elbow receiver tube in place.

An elbow extension tube 16 is received into the pivotal elbow receiver tube 56. The elbow extension tube, as illustrated, is comprised of a single piece of tubing having a square cross-section with sets of holes provided proximate both the proximal and distal ends thereof. To secure the elbow extension tube to the elbow assembly 16, the elbow extension tube is placed into the pivotal elbow receiver tube until the set of holes on the end of the extension tube align with the set of holes on the elbow receiver tube as well as the corresponding set of holes between the upper and lower plates 50&52. Accordingly, by placing a single pin through the sets of aligned holes, the angular orientation of the elbow is fixed and the elbow extension is secured in place. The length of the elbow extension tube can vary. For instance, a shorter tube will typically be utilized with the door breaching attachment 22 and a longer extension may be utilized with the distraction device delivery attachment 18.

Figure 20:
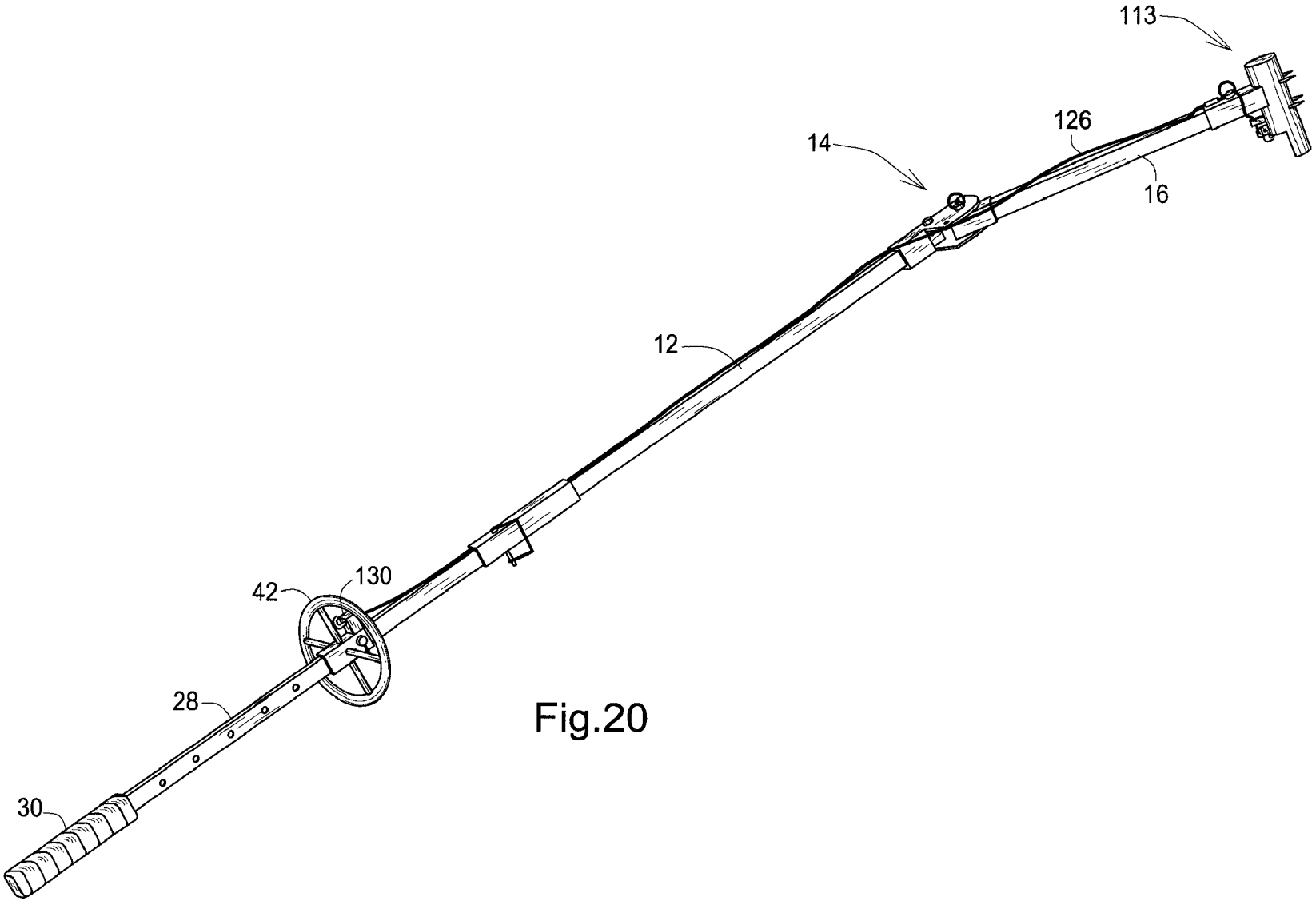
FIG. 20 is an isometric view of a yet another configuration of the tactical utility pole system including an attachment for delivering a chemical grenade into a building according to an embodiment of the present invention.

Referring to FIGS. 1, 2, 3, 4 & 20, an end attachment 18, 20, 22, 26 & 113 is secured to the distal end of the elbow extension tube 16. In FIG. 1, an attachment 18 for placing and detonating a single distraction device within a structure typically through window is shown. In FIG. 2, an attachment 20 for placing and separately detonating two distraction devices within a structure typically through window is shown. In FIG. 3, an attachment 22 for breaching a door is shown. In FIG. 4, an attachment 26 for breaking and raking a window and delivering an OC spray within the associated structure is shown. In FIG. 20, an attachment 113 for breaking a window in delivering a chemical grenade into the associated structure is shown. Each of these attachments is described below with reference to figures as appropriate.

Additionally, any number of other types of suitable attachments may be used with the tactical utility pole system. For instance, a camera attachment comprising a video camera and associated lights may be attached to an appropriately configured pole. Controls for the camera and the lights may be located at the handle assembly 36&42. In some variations of a camera attachment, the attachment may also include a speaker and a microphone to facilitate two-way communication between an occupant of the structure and the operator of the pole. Another attachment may comprise a container used for delivering items to within a structure. The container can include a door is actuatable by the user. Attachments containing other types of explosive rounds, including destructive explosives, are also contemplated although use of an attachment of this type would generally be limited, perhaps to military-type operations. Accordingly, it is to be appreciated that the various embodiments of the utility tactical pole system described herein are not to be considered limited by any particular attachment.

A Distraction Device Delivery Attachment Accordingly to an Embodiment

Figure 6:
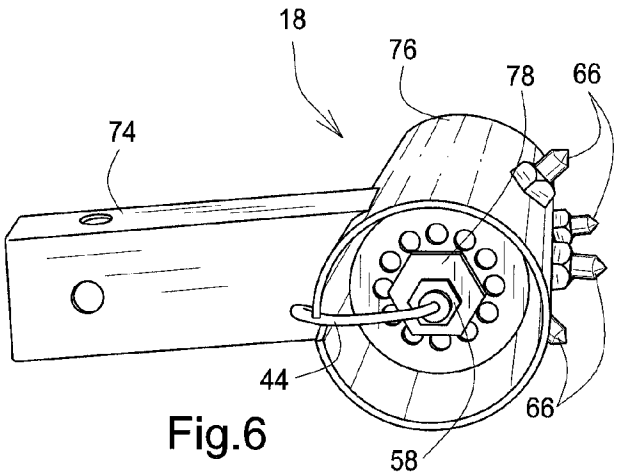
FIGS. 5 and 6 are different isometric views of a distraction device delivery attachment according to an embodiment of the present invention.
Figure 5:
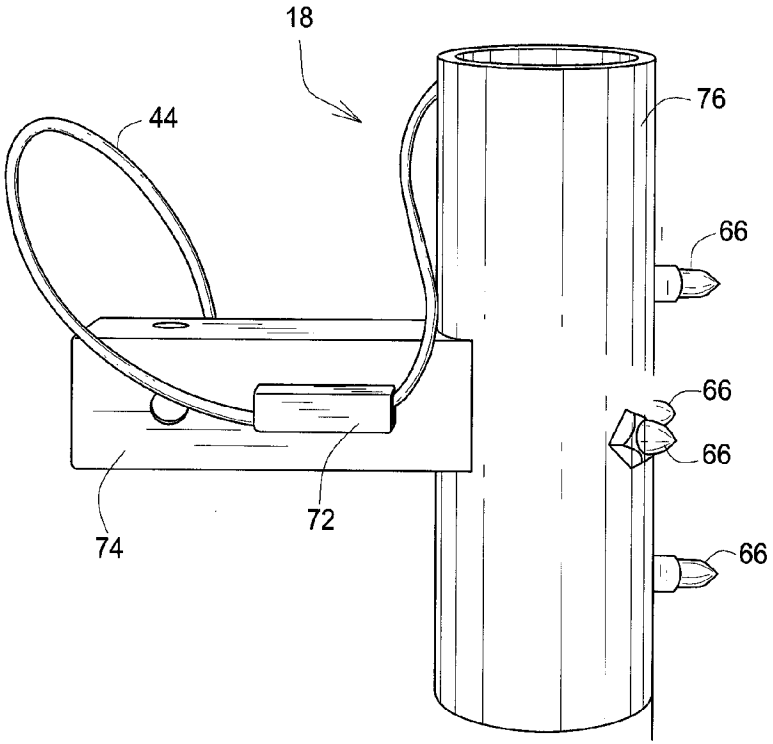

FIGS. 5 & 6 illustrate an attachment 18 configured to break through a window and detonate a distraction device 58 within the associated structure. The attachment comprises a cylindrical tube 76 with a receiver tube 74 extending perpendicularly therefrom proximate the middle of the cylindrical tube. On a portion of the tube surface generally opposite the location of the receiver tubes attachment, a plurality of small hardened steel spikes 66 are mounted and extend outwardly therefrom. In some variations, the spikes are threaded into corresponding threaded holes in the cylindrical tube allowing a replacement as necessary. The spikes are designed to initially fracture and shatter the glass upon impact. One type of suitable spike is a tungsten steel tipped spike (or stud) that is designed to be mounted to the bottom of horseshoes of horses that spend a substantial amount of time on pavement. Certain embodiments and variations utilize MXVI Studs or similarly configured studs as are available from Phalen Horseshoeing and Supply Company, 7821 Alabama Ave. STE 17, Canoga Park, Calif. 91304, 818-702-6375. These particular spikes have a 14" threaded male ends that are secured into threaded openings on the cylindrical tube housing.

Typically, a distraction device has a male threaded portion that is threaded into a corresponding threaded female portion (under 78) within the cylindrical tube. The shock tube 44 is secured to the distraction device and threaded out of the cylindrical tube through a guide 72 on the receiver tube, along the tactical utility pole as configured and attached to the pin gun. As shown, one or two sets of holes are provided on the receiver tube so that the attachment can be appropriately secured to the as configured utility pole using a quick release pin.

Figure 16:
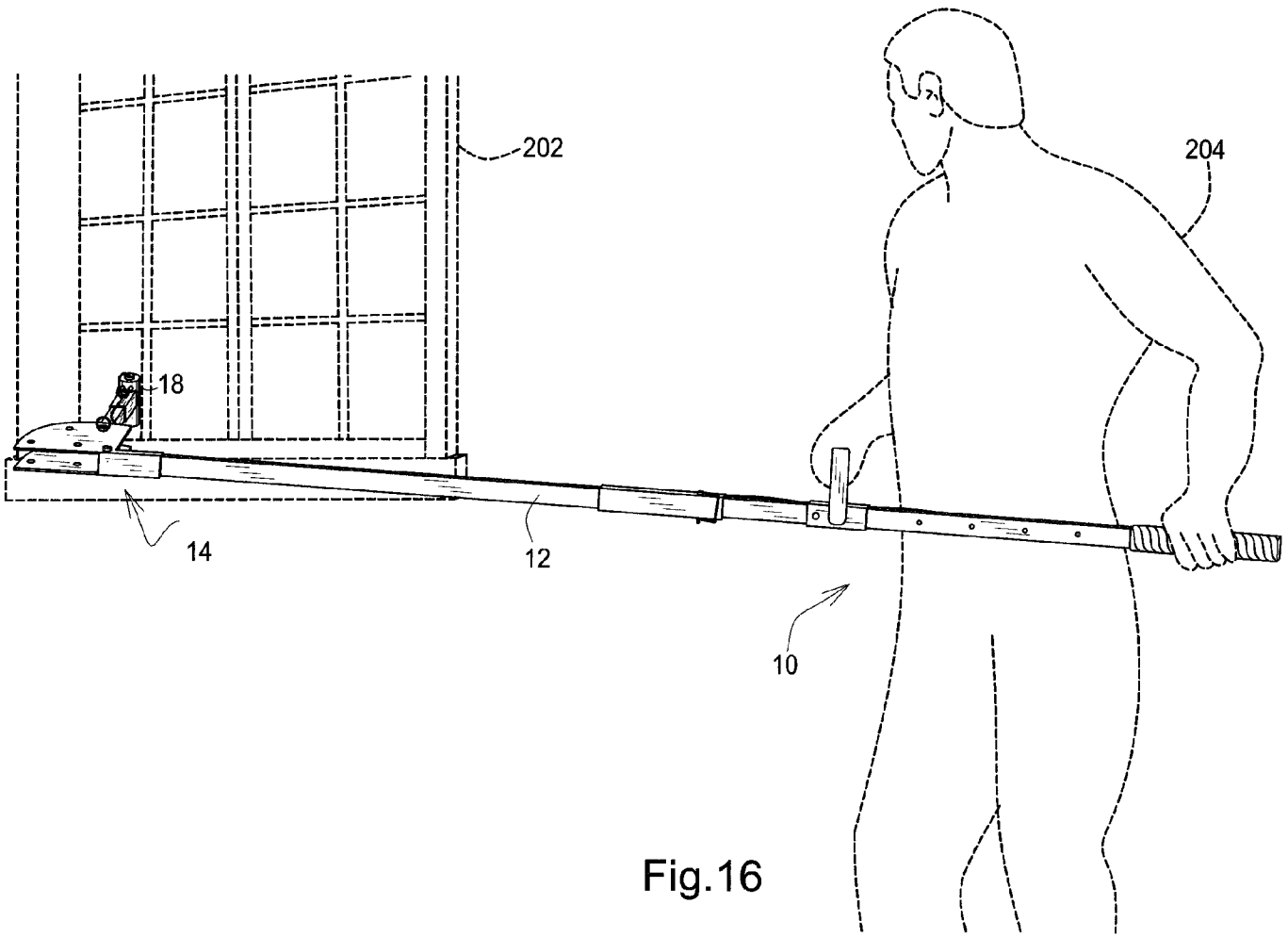
FIG. 16 is a depiction of a person using a configuration of the tactical utility pole system to break through a window with the intent of detonating a flash grenade in the associated structure according to one embodiment of the present invention.

FIG. 16 illustrates a tactical utility pole having the distraction device delivery attachment 18 attached thereto being operated by a user 204. Simply, a user swings the utility pole against a window opening 202 causing one or more of the spikes 66 to impact and break the associated pane of glass. Once the attachment is within the structure, the user typically detonates the distraction device by firing the pin gun.

Referring specifically to FIG. 1, a variation of the distraction device delivery attachment is shown that includes LED lamps 68 and a small video camera 70. Electrical wires typically extend from both the camera and the LED lamps to one or more triggers or switches on the handle assembly for controlling their operation. A small LCD screen may be mounted on the handle to give the user a view within the structure. Alternatively, a wireless transmission device may be provided and attached to the tactical utility pole system to transmit the video to a remote location. The actual locations of the lights and camera can vary substantially. For instance in many variations the camera and lights may be located within the protective body of the cylindrical tube 76. Whatever the configuration of the video camera, the ability to survey the area within the window prior to detonating the distraction device may be useful in certain situations.

This attachment and the other attachments described below may be comprised of any suitable material. Typically, however, the attachments that utilize a distraction device typically comprise steel or heavy gauge aluminum to withstand the forces related to detonation of one or more distraction devices. On the other hand, the attachments that are not subject to explosive forces or not utilized to break through a window may be comprised a lighter weight materials including plastic.

A Dual Distraction Device Delivery Attachment Accordingly to an Embodiment

Figure 7:
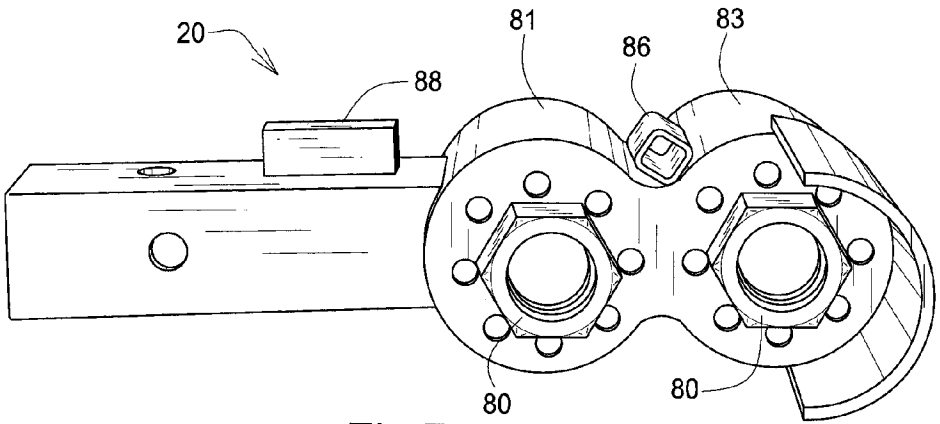
FIGS. 7 and 8 are different isometric views of another distraction device delivery attachment according to an embodiment of the present invention.
Figure 8:
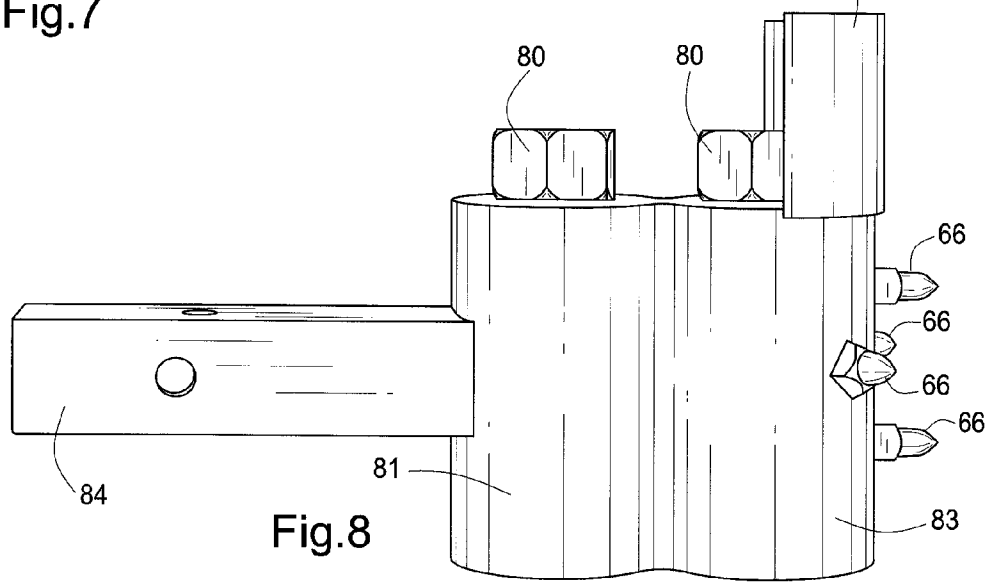

FIGS. 7 & 8 illustrate an attachment 20 configured to break through a window and detonate one or two distraction devices 58 within the associated structure. The attachment comprises a pair of cylindrical tubes 81 &83 connected together with a receiver tube 84 extending perpendicularly from proximate the middle of the rearmost cylindrical tube 81. On a portion of the frontmost tube's surface generally opposite the location of the receiver tube's attachment, a plurality of small hard and steel spikes 66 are mounted and extend outwardly therefrom. In some variations, the spikes are threaded into corresponding threaded holes in the cylindrical tube allowing a replacement as necessary. The spikes are designed to initially fracture and shatter the glass upon impact.

The top side of each of the cylindrical tubes as illustrated in FIG. 8 is generally closed and has a threaded nut welded 80 thereto. Each threaded nut is configured to receive it a distraction device therein. Extending upwardly from the front portion of the frontmost cylindrical tube is a protective guard portion 82. The protective guard portion generally protects the ends of the distraction devices and particularly their interface with respective shock tubes 44 from being damaged when the attachment device is smashed through a window pane. One or more guide tubes 86&88 may be provided on the cylindrical tubes or on the receiver to through which the shock tubes may be threaded. Additionally, one of more sets of holes are provided on the receiver tube to facilitate the mounting of the attachment to the configured tactical utility pole using a quick release pin.

Operation of the dual distraction device delivery attachment 20 is essentially similar to that of the single distraction device delivery attachment 18 excepting the ability to simultaneously or sequentially detonate two distraction devices. Furthermore, this attachment may also be configured with the camera and/or lamps.

Door Breaching Attachments According to Embodiments

Figure 10:
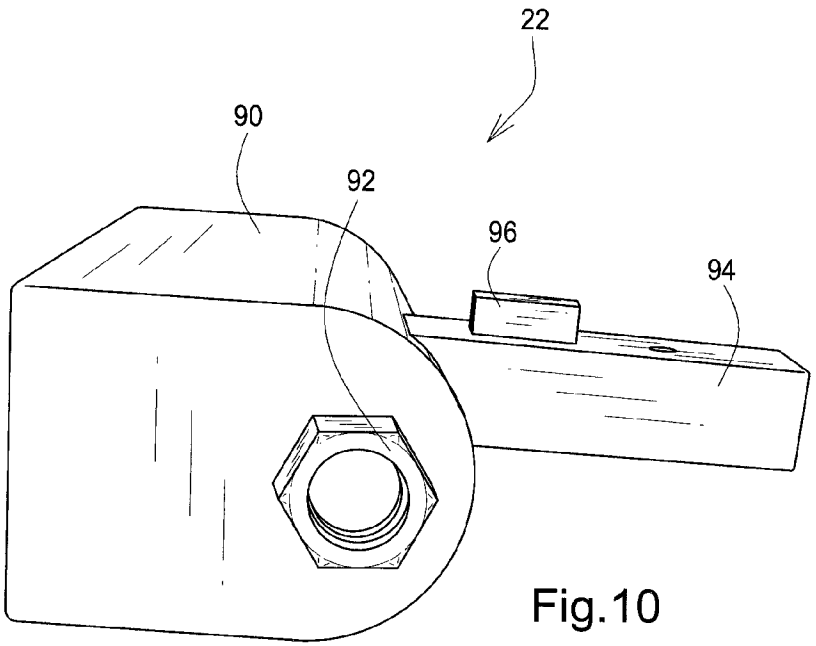
FIGS. 9 and 10 are different isometric views of a door breaching attachment according to an embodiment of the present invention.
Figure 9:
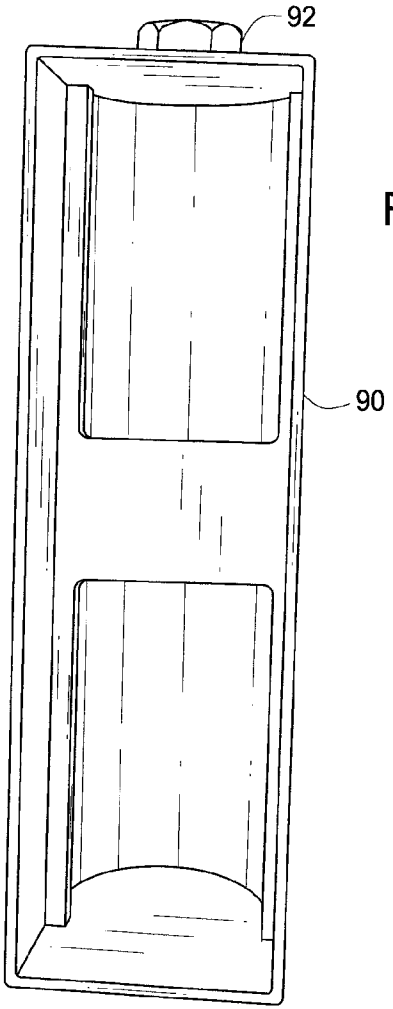
Figure 17:
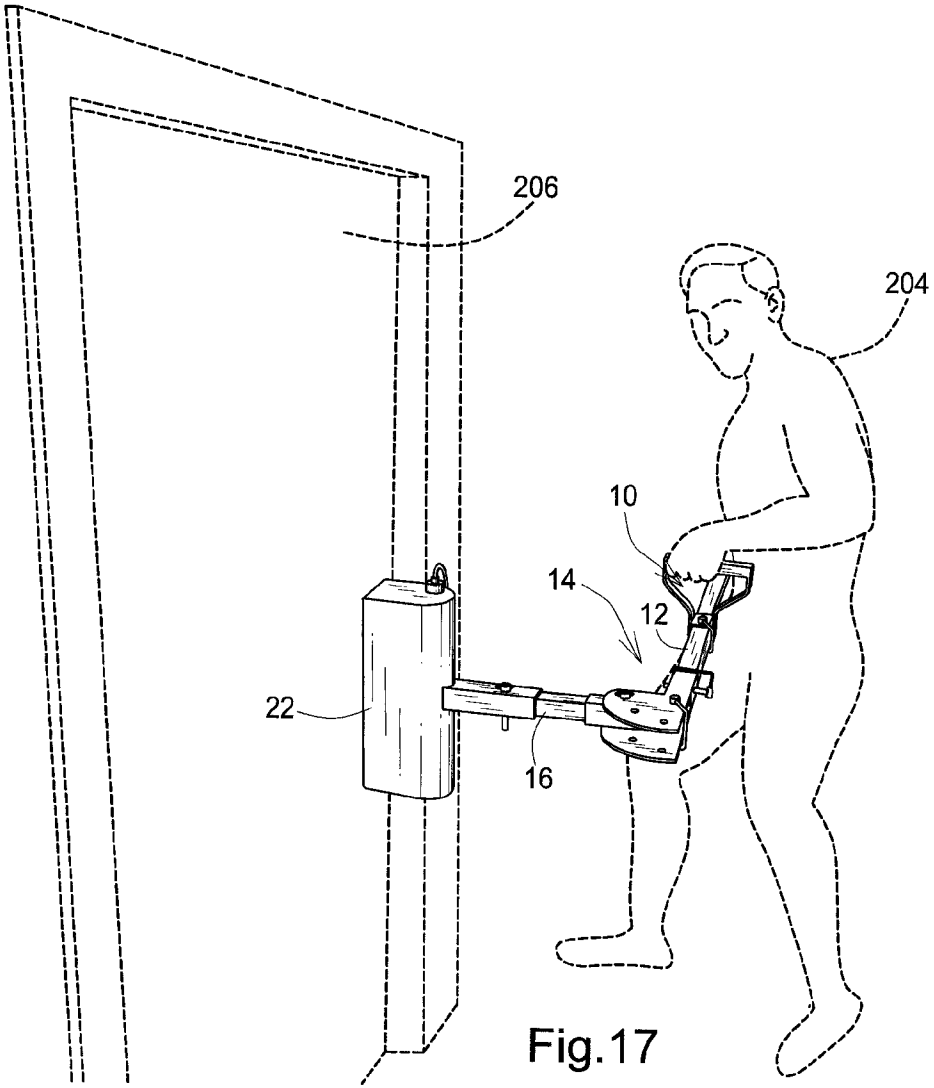
FIG. 17 is a depiction of a person using a configuration of the tactical utility pole system to gain entrance to a structure through a locked door according to one embodiment of the present invention.
Figure 19:
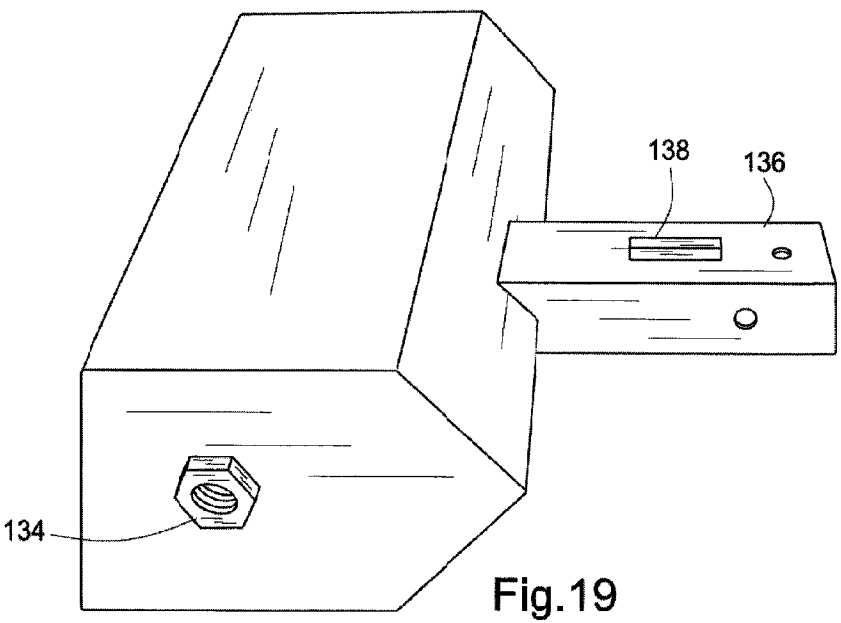
FIGS. 18 and 19 are different isometric views of another door breaching attachment according to an embodiment of the present invention.
Figure 18:
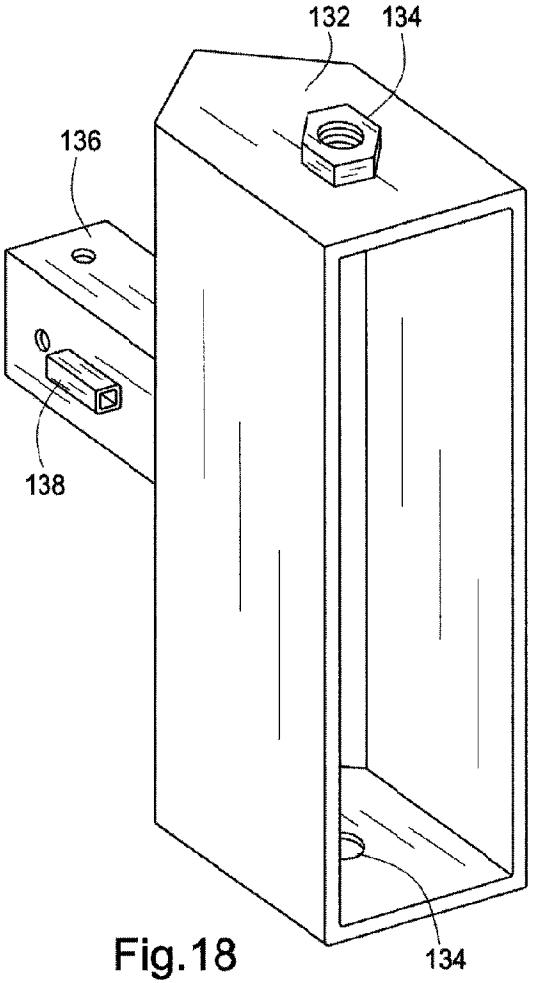

FIGS. 9 and 10 illustrate a door breaching attachment 22 for use with a single distraction device. FIGS. 18 and 19 illustrate a second type of door breaching attachment 24 that utilizes dual distraction devices 58 which are detonated simultaneously. Each of the door breaching attachments include a housing 90&132 having a substantially open front side that is held against a door 206 to be breached by a user 204 as indicated in FIG. 17. The perimeter of the front open side is typically substantially planar, such that it can fit flush against the flat side of the door. Opposite the substantially open front side a receiver tube 94&136 extends outwardly from a backside of the housing proximate the middle thereof.

On a top end of the door breaching attachment using a single distraction device, a threaded nut 92 is fixed thereto and is configured to receive a distraction device therein. On both the top and bottom ends of the door breaching device utilizing dual distraction devices, threaded nuts 134 are fixed to both ends so that distraction devices may be threaded into each.

Referring primarily to FIG. 10, the backside of the housing 22 may be curved or rounded to help direct the shock wave created by the detonation of the distraction outwardly towards the open front side and against the door. Alternatively, as illustrated in FIG. 19, the backside of the housing 132 may comprise a pair of inwardly canted sides that also act to direct the shockwave from both distraction devices outwardly towards the open front side.

As illustrated, one of more sets of holes are provided on the receiver tubes 94&136 to facilitate the mounting of the attachment to the configured tactical utility pole using a quick release pin Also, one or more guide tubes 96&138 may also be provided for threading one or more shock tubes therethrough.

Operationally with reference to FIG. 17, the open side of the door breaching attachment 24&24 is placed in direct contact with the front side of the door 206 proximate the opening side of the door. Most typically, the open side is placed over any handle or deadbolt hardware; although testing has shown placing the open side firmly against the door proximate the opening side of the door as close to the jamb as possible but not over the hardware is also very effective. Further, by placing the open side of the housing over a door knob, the user can rest the housing on the doorknob to provide additional support in holding the configured tactical utility pole in place. Preferably, pressure is applied by the user against the door to ensure a good seal between the open end and the door surface. Additionally, such pressure helps to counteract the explosive force of the shockwave upon detonation. Once in place, the user fires the pin gun, which in turn detonates the one or more distraction devices. The resulting shock wave is directed towards the door and facilitates the separation of the door from the door jamb. In some instances, the door jamb is destroyed and in other instances, locking mechanisms of the door hardware are freed from their mounting locations in the door. It is successful application of the utility pole system with the door breaching attachment, the door will swing open in at high velocity permitting immediate access by law enforcement personnel. The single distraction device door breaching attachment is typically used on lighter weight doors and/or doorways having wooden jambs; whereas, the dual distraction device door breaching attachment is typically used on heavier doors and/or doorways having steel jambs.

Figures 11, 12:
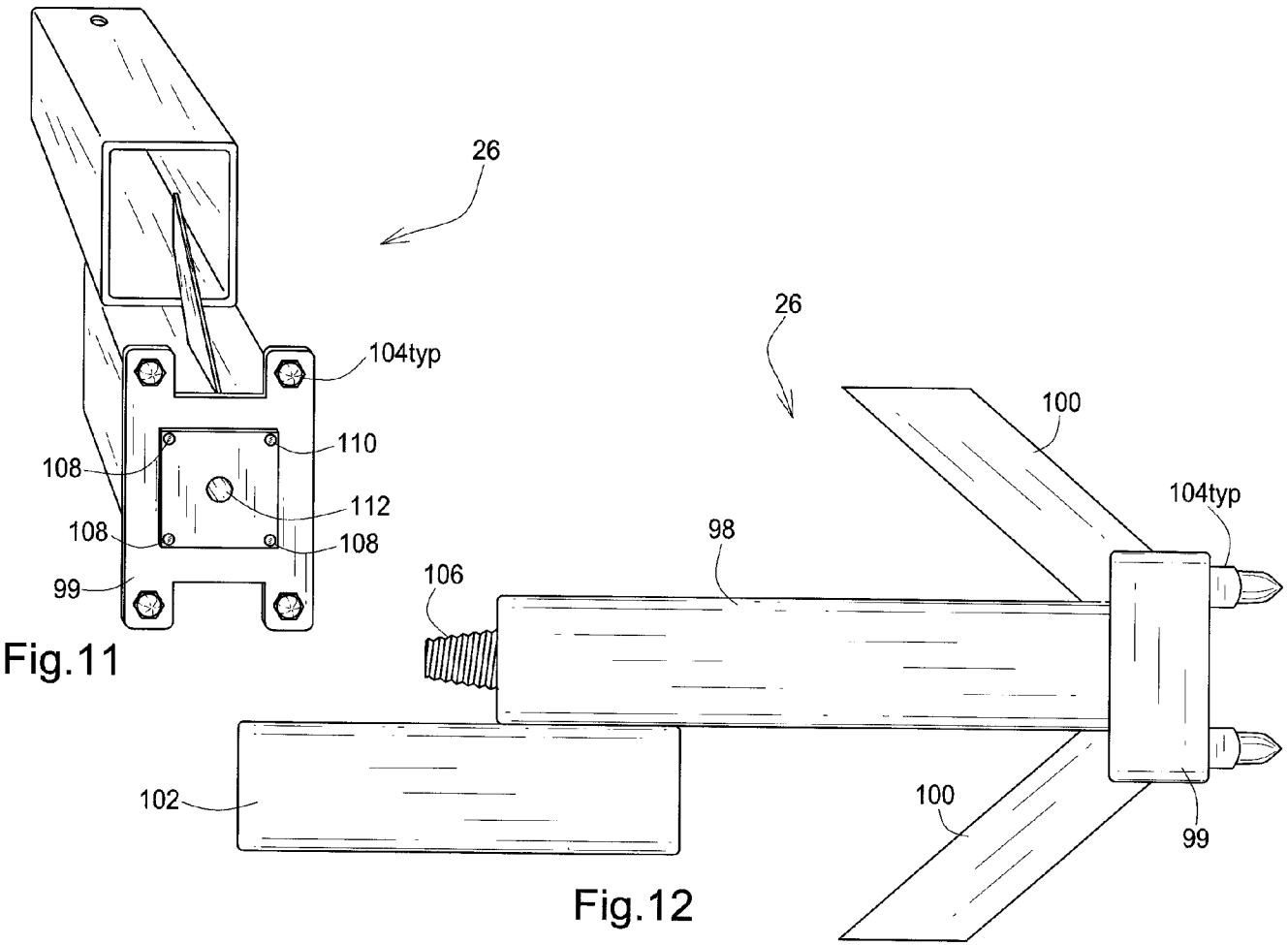
FIGS. 11 and 12 are different isometric views of an attachment for breaking and raking a window opening and delivering a chemical agent via spraying into an associated structure according to antibody meant of the present invention.

Attachment for Breaking and Raking a Window and Delivering a stream of OC Spray According to an Embodiment Referring to FIGS. 11 and 12, an attachment for (i) breaking glass panes of a window, (ii) subsequently raking any of obscuring material from the window opening, such as curtains and/or window blinds, and (iii) delivering a stream of OC spray into the room preferably towards an intended victim is illustrated. The attachment comprises a receiver tube 102 including one or more sets of holes for securing the attachment to an appropriately configured utility pole system. A proximal end of a second tube, or attachment body 98, having a generally square cross-section is attached to a top surface of the receiver tube generally proximate its distal end. A pair of rearwardly raking planar barbs 100 are attached, typically welded, to the body proximate its front or distal end. Also attached to the front end of the body is a metallic block 99 to which a plurality of breaching points 104 are attached. The center portion of the block is generally open corresponding with the opening in the end of the tubular body. In the illustrated embodiment, a plate is provided to which a conduit outlet is provided often with a suitable nozzle to facilitate the delivery of OC/pepper spray. Also provided on the face of the plate are one or more LED lights 108 and the camera lens port 110. At the back or proximal end of the body a tube grommet 106 is provided through which an OC spray delivery conduit 64 can be passed as well as any electrical wires associated with the LED lamps and or a video camera.

FIG. 4 illustrates a configuration of a tactical utility pole system incorporating the breaking and raking attachment 26. Most notable is a pressurized canister 60 of OC spray that is located proximate to handle hold portion 30 of the handle tube 28. Extending from the pressurized canister, along the length of the handle tube and the extension tubes utilized in this configuration is a spray delivery conduit 64. A spray delivery conduit terminates that the face plate in the attachment as described above. Accordingly, when a user releases OC spray from the canister by depressing and associated trigger, the spray travels along the conduit and is ejected out of a nozzle in the faceplate. The user may utilize a camera also mounted the faceplate to assist in aiming the stream of OC spray. The LED lamps are utilized as necessary to illuminate the interior of the structure. In certain instances, infrared LEDs may be utilized in place of those that produce primarily visible light. Accordingly, a user may be able to survey an area using this attachment (or other suitably configured attachment) using the camera without the presence of the tactical utility pole being detected. Of course, any stealth use of this attachment would not make sense in situations where the attachment was first used to break through window and rake the window opening clean as the noise of such operation would be significant and attention attracting.

In operation, a user will smash the front face of the attachment 26 and more particularly the breaching points 104 against a window pane thereby breaking the pane. Once through the pane, the user advances the attachment inwardly a short distance and then pulls it back to hook any obstructions such as window blinds or curtains on the attachment's barbs 100. Next, the user typically moves the attachment within the opening in a generally circular motion to hook and clear the remainder of the obstructions. The obstructions once cleared then typically fall to the ground either outside of the window opening or inside of the window opening. A user may need to shake a utility pole to free it from the cleared obstructions. Finally, as necessary and desired, the user delivers a stream of OC spray within the structure.

Attachment for Delivering a Chemical Grenade According to an Embodiment

Figure 14:
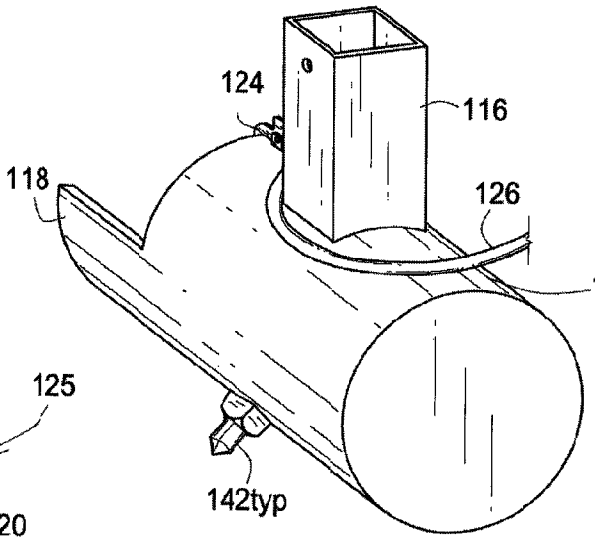
FIGS. 13 through 15 are different isometric views of an attachment designed to deliver a chemical grenade into a building through an opening.
Figure 15:
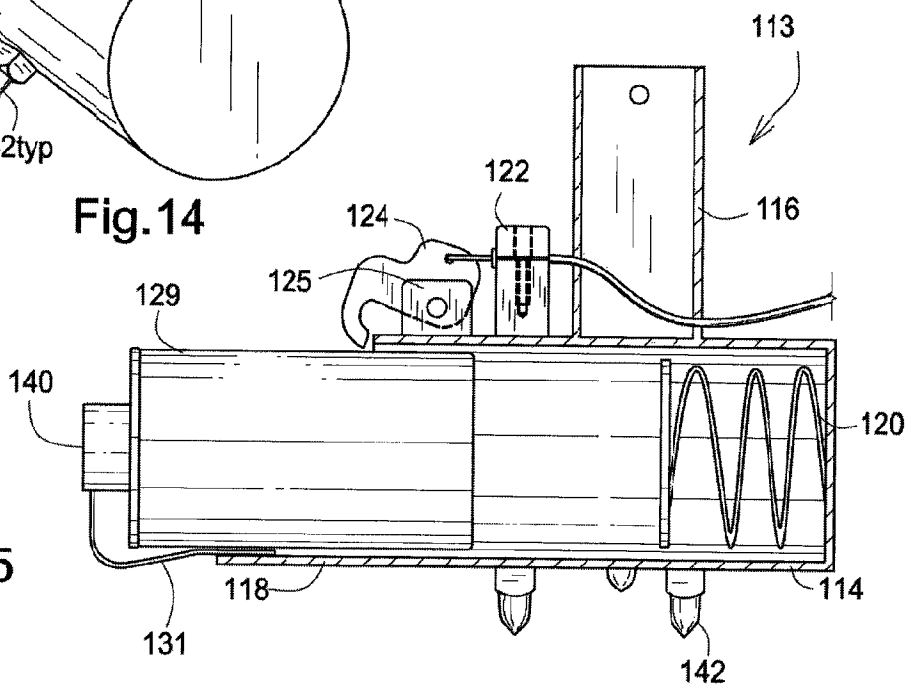
Figure 13:
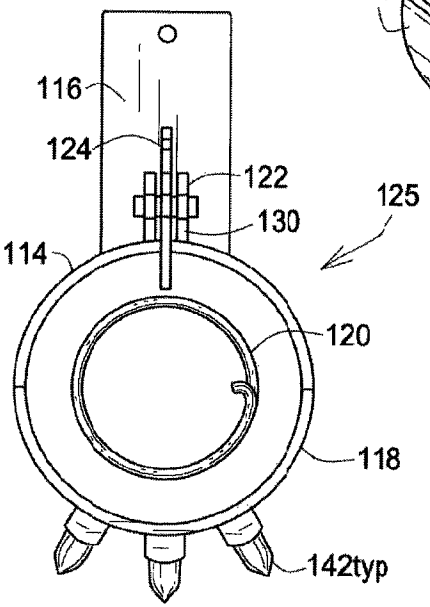

Referring to FIGS. 13-15, and attachment 113 for delivering a chemical or other type of grenade into a structure through window opening is illustrated. This attachment includes an inverted cylindrical cup member 114 having a closed top end with a receiver tube 116 extending perpendicularly outwardly from the cup's side. The cup member further includes an arcuate shield portion 118 that extends downwardly from the cup's bottom open end to protect the end of the grenade 129 generally and, more particularly, the grenade's fuze 140. A plurality of breaching points 142 are disposed on the surface of the cup member generally opposite the interface location of the receiver tube.

A latching mechanism that includes a latch 124 that overhangs the open end of the cup member to securely hold a grenade in place is also provided. A pivotal mount 125 for the latch is provided in the outside of the cup member proximate the open end. The latch itself is pivotally secured to the pivotal mount. A cable mount 122 is also provided located generally above the latch and pivotal mount. A cable and associated housing 126 extend from the cable mount to an actuator 130 typically located on or proximate the handle assembly is best illustrated in FIG. 20. The wired cable 126 is also coupled to the latch 124 so that when the actuator is actuated the latch is retracted from its position over the surface of the cup member opening.

A biasing spring 120 is located at the underside of the close top end of the cup 118. The grenade canister is pressed against the spring compressing it while the latch holds the grenade in place within the cup member. The grenade includes a fuze 140 coupled with a spoon 131. When the fuse is activated, the grenade detonates a few seconds thereafter. The fuze is initially activated by releasing the spoon. However, when the grenade is contained within the cup member, the spoon is held tightly against the body of the grenade preventing activation of the fuze. When the latch is released, biasing spring is permitted to expand and eject the chemical grenade. Upon ejection, the spoon springs outwardly from the grenade body and activates the fuze. Upon detonation, the chemical contained in the grenade is released.

As with several of the other attachments, cameras or LED lamps may be coupled to or integrated with the chemical grenade delivery attachment. When this attachment is utilized combination with an appropriately configured utility pole, a user can precisely determine the way a chemical grenade will be detonated in contrast to throwing a grenade into a structure, such as through window.

OTHER EMBODIMENTS AND VARIATIONS

The various preferred embodiments and variations thereof illustrated in the accompanying figures and/or described above are merely exemplary and are not intended to limit the scope of the invention. It is to be appreciated that numerous variations to the invention have been contemplated as would be obvious to one of ordinary skill in the art with the benefit of this disclosure. All variations of the invention that read upon the appended claims are intended and contemplated to be within the scope of the invention.

For instance, the mechanism used to remotely detonate the distraction devices can vary significantly and substantially from the mechanism described herein. For instance, an electronic detonator may be used wherein a distraction device having or accepting an electronic igniter replaces the distraction device described herein above. In this variation, electrical wires extend wither along the outside of the configured utility pole to a button/switch located proximate or on the handle assembly. The wires would also be connected to a suitable power source, such as a battery pack. By depressing the button, the distraction device is detonated immediately thereafter without any appreciable delay. A second switch may also be included in a separate location to act as a safety that must be switched to arm the mechanism. In another variation, the mechanism may be substantially similar to the mechanism described above except that the pin gun is designed to be fired electronically and is mounted either on an extension pole closer to the attachment or on the attachment itself. In this variation, a shock tube would still extend from the pin gun to the distraction device albeit a shorter distance, and the pin gun would be coupled to a button/switch on the handle tube or handle assembly by way of electrical wires also coupled to a power source. By depressing the button, a solenoid or other electrical device would release the hammer of the pin gun to detonate the primer charge which would in turn detonate the distraction device. In either of these alternative variations, a wireless controller might be coupled with the electronics to provide the capability of a person other than the user holding the tactical utility pole to detonate the distraction device. The ability to remotely detonate might be desirable where a person standing away from the user who has a better view of the entire situation can decide exactly the moment to detonate without incurring any delay that might result from having to signal the user to detonate.

As also discussed above, the various attachments may include cameras, lamps, microphones and/or speakers. Also, specific attachments can be provided that comprise any combination of the foregoing. These various items can be utilized in combination with associated electronic devices such as but not limited to wireless transceivers, strobe circuitry, and sound generators. For instance, an attachment designed to deliver an item, such as medicine, to a person within a structure might includes flashing colored LEDs and a siren. In other variations, a view from a camera may be transmitted to a remote location, such as an operation command post, wirelessly.

Many of the particulars concerning the construction and configurations of the utility pole system may vary as well. For instance, bolts or other mechanism could be used to couple the various tubular sections together. Snap-lock fittings may be provided on the ends of the various tubes to facilitate their quick coupling and uncoupling. Sophisticated coupling mechanisms may include electrical contacts that connect various electrical wires together. Electrical connectors may be provided on the attachments or tube sections to permit a user to quickly couple electronics to control switches and a power source. The elbow assembly can vary as well wherein the angle may be infinitely adjustable instead of having two or three specific angular configurations.

Further, it is understood that the attachments described herein are exemplary only and that numerous other types of attachments can be utilized with the tactical utility pole system as would be obvious to one of ordinary skill in the art given the benefit of this disclosure. Furthermore, although this device is primarily described in relation to hostage situations and by police and paramilitary, the tactical utility pole can be used in other types of situations as well, such as, but not limited to, military operations and various rescue operations that do not involve hostages and their captors.

I claim:

1. A tactical utility pole system comprising:

a handle section including at least one portion adapted to be griped by a user;

one or more extension boom sections;

an elbow section having a first end and a second end, the first end being adapted to couple with the handle section or at least one of the one or more extension boom sections and the second end being adapted to couple at least one of the one or more extension boom sections, the first and second ends adapted to form one or more angles relative to each other;

one or more attachments adapted to couple with one of the one or more extension booms, the one or more attachments being from the group consisting of, (i) a distraction device delivery attachment, the distraction device delivery attachment adapted to secure one or more distraction round on the attachment and break one or more window panes when in use, (ii) a door breaching attachment, the door breaching attachment adapted for breaching a locked door by directing a shock wave created by a distraction round at the door when in use, (iii) a chemical spray delivery attachment, the chemical spray delivery attachment adapted to secure a chemical spray therein, break one or more window panes and rake a window opening to clear window covers and debris when in use and (iv) a chemical grenade delivery attachment, the chemical grenade delivery attachment adapted to irremovably secure a chemical grenade therein, break one or more window panes and discharge the chemical grenade therefrom when in use; and one or more switches and/or actuators located on or proximate the handle section for activating one or more features of the at least one attachment.

2. The tactical utility pole system of claim 1, further comprising a plurality of pins, the pins being adapted to couple and secure the various sections and an attachment of the one or more attachments together by way of holes provided in the sections and the attachment to create a tactical utility pole assembly.

3. The tactical utility pole system of claim 1 further comprising a plurality of quick release couplings adapted to couple the sections and an attachment of the one or more attachments together in a first assembly and permit rapid reconfiguration into a second assembly all without the use of extraneous tools.

4. The tactical utility pole system of claim 1 wherein at least one of the one or more attachments comprises the distraction device delivery attachment, the distraction device delivery attachment comprising: (i) a housing having an interior adapted to at least partially receive one or more distractions rounds therein; (ii) one or more threaded openings adapted to secure the distraction round within the interior; (iii) a plurality of breaching spikes coupled to the housing, and (iv) an attachment end adapted to couple with an extension boom of the one or more extension boom sections.

5. The tactical utility pole system of claim 1 wherein at least one of the one or more attachments comprises the door breaching attachment, the door breaching attachment comprising: (i) a housing having one substantially open front side with a substantially planar perimeter edge adapted to fit flush against a planar surface; (ii) one or more threaded openings adapted to secure one or more distraction rounds within an interior of the housing; and (iii) and an attachment end adapted to couple with an extension boom of the one or more extension boom sections.

6. The tactical utility pole system of claim 1 wherein the handle section and the one or more extension boom sections comprise tubes having a non-circular cross sections.

7. The tactical utility pole system of claim 6 wherein the tubes have a substantially square cross section and comprise an aluminum alloy.

8. The tactical utility pole system of claim 6, wherein (i) each of the one or more attachments include an attachment end, (ii) each attachment end and the first and second ends of the elbow section have non-circular cross sections substantially similar in shape to the non-circular cross sections of the one or more extension tube sections and the handle section and (iii) each of the attachment ends and the first and second ends of the elbow section are adapted to be received over and/or within corresponding ends of the one or more extension tube sections and/or the handle section.

9. The tactical utility pole system of claim 1 wherein the one or more switches and/or actuators comprises a pin gun, the pin gun being adapted to operatively couple with an distraction round on at least one attachment of the one or more attachments by way of a shock tube.

10. The tactical utility pole system of claim 9 wherein the distraction round comprises a #25CI made by Defense Technology of Casper, Wyoming or similarly configured distraction rounds.

11. The tactical utility pole system of claim 1 wherein at least one of the one or more attachments includes at least one of lights and a video camera coupled thereto.

12. The tactical utility pole system of claim 1 wherein at least one of the one or more attachments includes at least one of a speaker and a microphone coupled thereto.

13. The tactical utility pole system of claim 1 wherein the one or more angles comprises at least 45 degrees and 90 degrees.

14. The tactical utility pole system of claim 1 adapted to form an assembly, the assembly comprising: a handle section including a pin gun mounted to the handle section; a first extension boom section coupled to a distal end of the handle section at a proximal end of the first extension boom section; an elbow section coupled at the first end of the elbow section to the distal end of the first extension boom section; a second extension boom section mounted to the second end of the elbow section at a proximal end of the second extension boom section, the longitudinal axis of the first and second extension boom sections form a right angle; and the door breaching attachment coupled to a distal end of the second extension boom section, the door breaching attachment including at least one distraction round mounted thereto with a shock tube extending between the pin gun and the distraction round.

15. The tactical utility pole system of claim 1 adapted to form an assembly, the assembly comprising: a handle section including a pin gun mounted to the handle section; a first set of one or more extension boom sections longitudinally coupled together and attached at first set first end to a distal end of the handle section; an elbow section coupled at the elbow section first end to a first set second end, the first set second end being opposite the first set first end; a second set of one or more extension boom sections longitudinally coupled together and attached at a second set first end to the elbow section second end, the longitudinal axis of the first and second sets forming a 45-degree angle; and a distraction device delivery attachment coupled to a distal end of the second extension boom section, the distraction device delivery attachment including at least one distraction round mounted therein with a shock tube extending between the pin gun and the distraction round.

16. A tactical utility pole system comprising:

a handle tube having a non-circular cross section, a pair of hand holds and at least one receiver end with at least a pair of aligned pin holes extending through the handle tube along an axis generally perpendicular to a longitudinal axis of the handle tube;

a plurality of extension tubes having a similar non circular cross section as the handle tube, each extension tube having opposing receiver ends with at least a pair of aligned pin holes extending through the extension tube along an axis generally perpendicular to a longitudinal axis of the extension tube;

an elbow section having first and second receiver tube ends, each of the first and second receiver tube ends having a similar non circular cross section as the plurality of extension tubes and including at least a pair of aligned pin holes extending through the receiver tube end along an axis generally perpendicular to a longitudinal axis of the receiver tube end, the angular position of the first and second receiver tube ends being adjustable relative to each other between two or more positions;

an attachment comprising one of (i) a distraction round delivery attachment, the distraction round delivery attachment adapted to secure one or more distraction round on the attachment and break one or more window panes when in use, (ii) a door breaching attachment, the door breaching attachment adapted for breaching a locked door by directing a shock wave created by an distraction round at the door when in use, (iii) a chemical spray delivery attachment, the chemical spray delivery attachment adapted to secure a chemical spray therein, break one or more window panes and rake a window opening to clear window covers and debris when in use, and (iv) a chemical grenade delivery attachment, the chemical grenade delivery attachment adapted to irremovably secure a chemical grenade therein, break one or more window panes and discharge the chemical grenade therefrom when in use, each attachment including an attachment receiver tube end having a similar non circular cross section as the plurality of extension tubes and including at least a pair of aligned pin holes extending through the attachment receiver tube end along an axis generally perpendicular to a longitudinal axis of the attachment receiver tube end; and a plurality of pins sized to slide within the aligned pin holes of the various sections and the attachment;

wherein each of the various receiver ends and receiver tube ends are adapted to either slide over or within another of the various receiver ends and receiver tube ends causing corresponding pairs of aligned pin holes to align and receive a pin of the plurality of pins therein to couple the respective sections or section and attachment together.

* * * * *